US007850493B2

(12) United States Patent
Lee et al.

(10) Patent No.: US 7,850,493 B2
(45) Date of Patent: Dec. 14, 2010

(54) CONNECTOR WITH FOOLPROOF STRUCTURE

(75) Inventors: Yi-Bin Lee, Taoyuan Hsien (TW); Yu-Yuan Dai, Taoyuan Hsien (TW); Bo Bai, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/388,889

(22) Filed: Feb. 19, 2009

(65) Prior Publication Data

US 2010/0167567 A1 Jul. 1, 2010

(30) Foreign Application Priority Data

Dec. 31, 2008 (TW) ..... 97151543 A

(51) Int. Cl.
*H01R 13/64* (2006.01)

(52) U.S. Cl. ..... 439/677; 439/680

(58) Field of Classification Search ..... 439/676, 439/677, 680

See application file for complete search history.

(56) References Cited

U.S. PATENT DOCUMENTS

| | | | | |
|---|---|---|---|---|
| 6,296,528 | B1 * | 10/2001 | Roberts et al. | 439/676 |
| 6,416,364 | B1 * | 7/2002 | Shi et al. | 439/680 |
| 6,918,794 | B2 * | 7/2005 | Wan et al. | 439/676 |
| 6,966,798 | B1 * | 11/2005 | Wu | 439/677 |
| 7,037,141 | B1 * | 5/2006 | Huang | 439/676 |
| 7,594,829 | B2 * | 9/2009 | Vaden et al. | 439/680 |
| 7,670,194 | B1 * | 3/2010 | Fitzpatrick | 439/680 |
| 2005/0215125 | A1 * | 9/2005 | Matsumoto et al. | 439/680 |
| 2008/0194147 | A1 * | 8/2008 | Wu et al. | 439/620.21 |
| 2008/0220657 | A1 * | 9/2008 | Rascon et al. | 439/676 |

* cited by examiner

*Primary Examiner*—Tho D Ta
(74) *Attorney, Agent, or Firm*—Muncy, Geissler, Olds & Lowe, PLLC

(57) ABSTRACT

A connector includes a housing and a base. The housing has a receiving hole for receiving a first-type plug. The base is assembled with the housing and has at least one foolproof structure. The foolproof structure and the base are formed as a single piece. The foolproof structure is protruded inside the receiving hole for blocking an insertion of an incompatible plug.

13 Claims, 2 Drawing Sheets

CONNECTOR WITH FOOLPROOF STRUCTURE

CROSS REFERENCE TO RELATED APPLICATIONS

This Non-provisional application claims priority under 35 U.S.C. §119(a) on Patent Application No(s). 097151543 filed in Taiwan, Republic of China on Dec. 31, 2008, the entire contents of which are hereby incorporated by reference.

BACKGROUND OF THE INVENTION

1. Field of Invention

The present invention relates to a connector and, in particular, to a connector with high yield rate, less production time, simplified manufacturing process and low cost.

2. Related Art

In general, because the RJ11 connector plug and the RJ45 connector plug are similar, they are easily inserted into incompatible jacks. The connector having no appropriate foolproof structure disposed thereon will be damaged due to an error of insertion.

Accordingly, the conventional connector is provided with an external foolproof structure so as to prevent incorrect insertion. Because the foolproof structure is an external element, additional molding process, positioning process and fastening process are required during the production process of the conventional connector, resulting in problems of low yield rate, more production time, complicated process and high cost.

SUMMARY OF THE INVENTION

In view of the foregoing, the invention is to provide a connector with high yield rate, less production time, simplified manufacturing process and low cost.

To achieve the above, the present invention discloses a connector including a housing and a base. The housing has a receiving hole for receiving a first-type plug. The base is assembled with the housing and has at least one foolproof structure. The foolproof structure and the base are formed as a single piece. The foolproof structure is protruded inside the receiving hole to block an insertion of an incompatible plug.

The connector further includes a circuit board and a shielding. The circuit board is connected to the base, and the shielding covers the housing and the base. The shielding is made of metal or a conductive material.

In the connector of the present invention, the housing and the base could be plastic, carbon fiber or insulating material. The foolproof structure has a barricade, and the barricade and the foolproof structure are formed as a single piece. An extension of the barricade tilts with an angle related to that of the end of the foolproof structure. The foolproof structure is deformed or rotated when the first-type connector is inserted into the receiving hole.

In addition, the base is formed by injection molding, molding or cutting. The base is disposed at back side of the housing. The base further includes at least one lead electrically connected to a circuit board, an electric element or a system. The quantity of the foolproof structure can be one or more.

Moreover, the connector is an RJ11 connector, an RJ45 connector, a USB connector or a bridge.

In summary, the foolproof structure of the connector according to the present invention is extended out of the base so that additional forming, positioning and fastening process are not in need so as to increase the yield rate and decrease the production time, process complication and production cost. Moreover, when the material of the base is plastic, the foolproof structure has advantages of better elasticity, lower cost, superior durability, easier forming and precise positioning.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
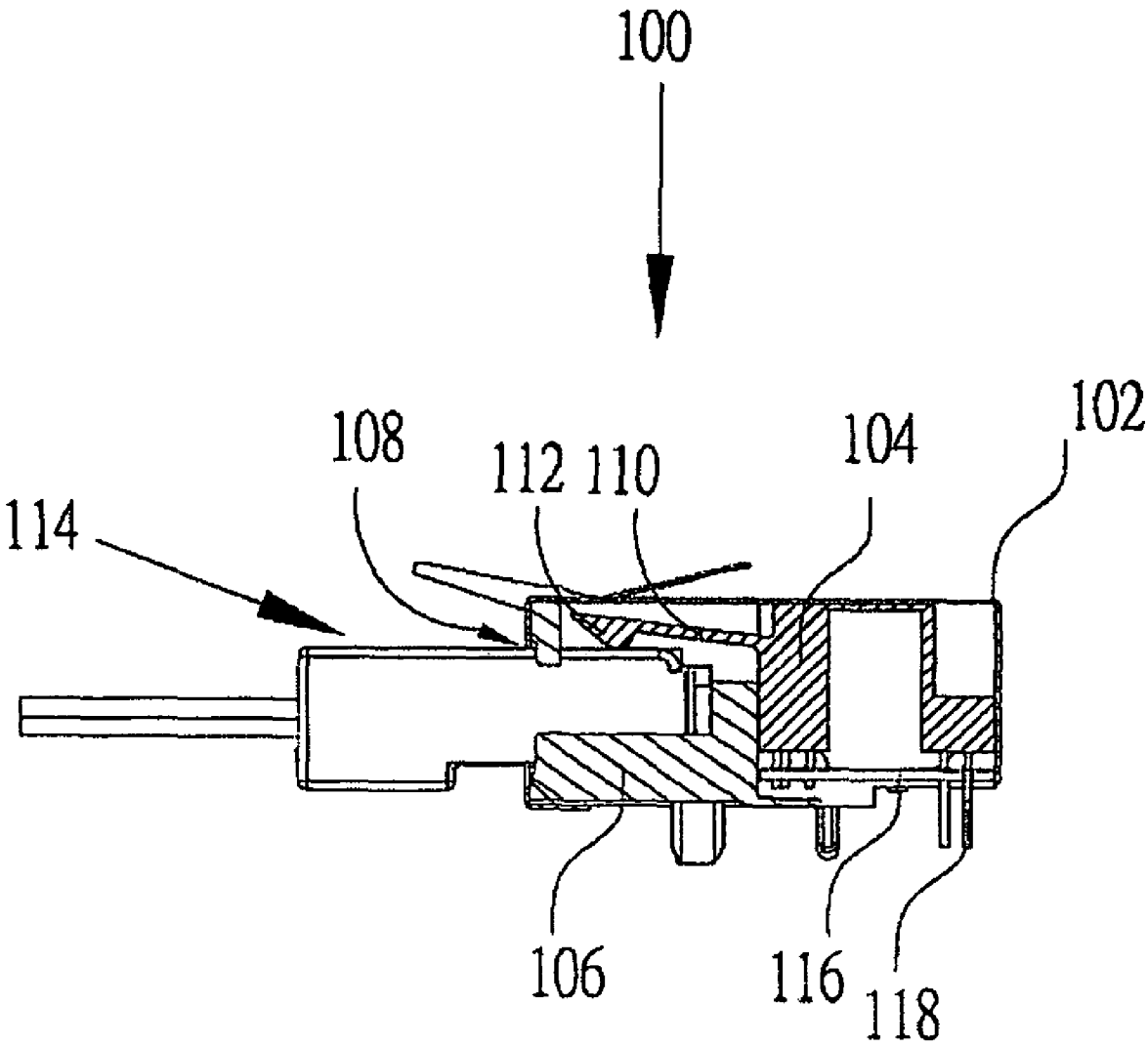
FIG. 1 is a sectional view of a connector and a first-type plug according to the present invention.

FIG. 1 is a sectional view of a connector 100 and a first-type plug 114 according to the present invention. Referring to FIG. 1, the connector 100 includes a housing 106 and a base 104. The connector 100 can be an RJ11 connector, an RJ45 connector, a USB connector or a bridge.

The housing 106 has a receiving hole 108 for receiving the first-type plug 114. The material of the housing 106 can be plastic, carbon fiber or insulating material.

The base 104 is assembled with the housing 106. More specifically, the base 104 is disposed at back side of the housing 106. The base 104 has at least one foolproof structure 110. The foolproof structure 110 and the base 104 are formed as a single piece. The material of the base 104 can be plastic, carbon fiber or insulating material. The base 104 can be formed by injection molding, molding or cutting.

Figure 2:
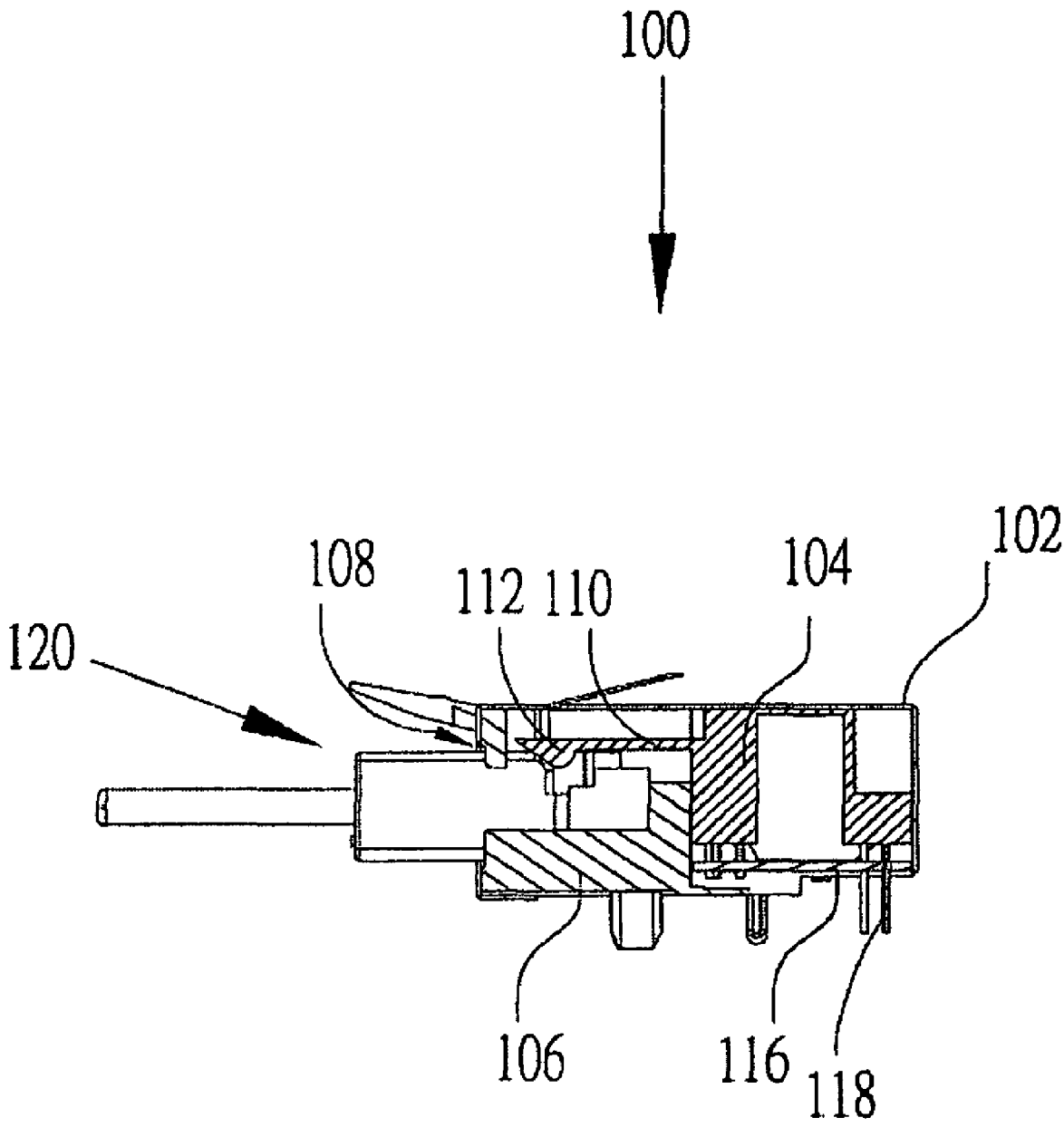
FIG. 2 is a sectional view of a connector and a second-type plug according to the present invention.

The foolproof structure 110 is protruded inside the receiving hole 108. When a first-type plug 114 is inserted into the receiving hole 108, the foolproof structure 110 is rotated or deformed so that the first-type plug 114 can be inserted into the receiving hole 108 completely. Moreover, as shown in FIG. 2, when an incompatible plug, such as a second-type plug 120, is inserted into the receiving hole 108, the foolproof structure 110 is not rotated or deformed so as to block movement of the second-type plug 120. The quantity of the foolproof structure 110 can be one or more.

The foolproof structure 110 includes a barricade 112. The barricade 112 and the foolproof structure 110 are formed as a single piece, and an extension direction of the barricade 112 tilts with an angle related to that of the end of the foolproof structure 110. The barricade 112 can also prevent the connector 100 from misinsertion.

The connector 100 includes a circuit board 116 connected to the base 104. The circuit board 116 has a circuit or an electric element disposed thereon, thereby achieving calculation, control, transmission or filter function.

The base 104 further includes at least one lead 118 electrically connected to the circuit board 116, electric element or system. The lead 118 can be also served as a link terminal between the first-type plug 114 and the circuit board 116, electric element or system.

The connector further includes a shielding 102. The shielding 102 covers the housing 106 and the base 104, thereby protecting the housing 106 and the base 104, and providing the noise shielding for the connector 100. The shielding 102 is metal or conductive material.

In summary, the foolproof structure of the connector according to the present invention is extended out of the base so that additional forming, positioning and fastening process are not in need so as to increase the yield rate and decrease the production time, process complication and manufacturing cost. Moreover, when the material of the base is plastic, the foolproof structure has advantages of better elasticity, lower cost, superior durability, easier forming and precise positioning.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A connector comprising:

a housing having a receiving hole for receiving a first-type plug; and a base assembled with the housing and having at least one foolproof structure protruding inside the receiving hole;

wherein the base further comprises at least one lead electrically connected to a circuit board, an electric element or a system;

wherein the foolproof structure is rotated or deformed when a first-type plug is inserted into the receiving hole; and wherein the foolproof structure and the base are formed as a monolithic piece, and the foolproof structure is used to block an insertion of an incompatible plug.

2. The connector according to claim 1, wherein the material of the housing is plastic, carbon fiber or insulating material.

3. The connector according to claim 1, wherein the base is plastic, carbon fiber or insulating material.

4. The connector according to claim 1, wherein the connector is an RJ11 connector, an RJ45 connector, a USB connector or a bridge.

5. The connector according to claim 1, wherein the quantity of the foolproof structure is one or more.

6. The connector according to claim 1, wherein the base is disposed at back side of the housing.

7. The connector according to claim 1, wherein the base is formed by injection molding, molding or cutting.

8. The connector according to claim 1, further comprising a circuit board connected with the base.

9. The connector according to claim 8, wherein the circuit board has a circuit or an electric element disposed thereon.

10. The connector according to claim 1, further comprising a shielding covering the housing and the base.

11. The connector according to claim 10, wherein the shielding is metal or conductive material.

12. The connector according to claim 1, wherein the foolproof structure comprises a barricade and an extension direction of the barricade tilts with an angle related to that of the end of the foolproof structure.

13. The connector according to claim 12, wherein the barricade and the foolproof structure are formed as a single piece.

* * * * *